US005422459A

United States Patent [19]

Zhou

[11] Patent Number: 5,422,459

[45] Date of Patent: Jun. 6, 1995

[54] HOT PLATE WITH SHAPED DOUBLE WALLED ELECTRIC HEATING ELEMENT TO PROMOTE HEAT TRANSFER

[75] Inventor: Yanzeng Zhou, Zhoucun, China

[73] Assignee: Zibo Electrothermal Appliances Factory, Zibo, China

[21] Appl. No.: 957,083

[22] Filed: Oct. 6, 1992

[30] Foreign Application Priority Data

May 11, 1992 [CN] China ..... 92106429.2

[51] Int. Cl.[6] ..... H05B 3/68

[52] U.S. Cl. ..... 219/459; 219/462; 219/465; 219/540

[58] Field of Search ..... 219/443–468, 219/530, 540; 165/171; 392/432–438

[56] References Cited

U.S. PATENT DOCUMENTS

| | | | |
|---|---|---|---|
| 2,199,650 | 5/1940 | Price | 219/460 |
| 2,389,588 | 11/1945 | Woodman | 219/540 |
| 2,662,158 | 12/1953 | Vallorani et al. . | |
| 2,875,312 | 2/1959 | Norton | 392/480 |
| 2,890,318 | 6/1959 | Kruse | 219/462 |
| 2,940,737 | 6/1960 | Sandberg | 165/171 |
| 3,885,128 | 5/1975 | Dills | 219/462 |
| 4,023,557 | 5/1977 | Thorne et al. | 165/171 |
| 4,098,261 | 7/1978 | Watt | 165/171 |
| 4,431,908 | 2/1984 | Fischer et al. . | |
| 4,998,584 | 3/1991 | Foglesonger et al. | 165/171 |

FOREIGN PATENT DOCUMENTS

| | | | |
|---|---|---|---|
| 222176 | 5/1987 | European Pat. Off. | 165/171 |
| 893149 | 5/1944 | France | 219/459 |
| 641336 | 1/1937 | Germany | 392/435 |
| 1540717 | 8/1969 | Germany | 219/462 |
| 3312312 | 10/1984 | Germany . | |
| 52-22153 | 2/1977 | Japan | 165/171 |
| 8901122 | 2/1989 | WIPO | 165/171 |

*Primary Examiner*—John A. Jeffery

*Attorney, Agent, or Firm*—Roylance, Abrams, Berdo & Goodman

[57] ABSTRACT

A ordinary electric heating-tube is sleeved with an aluminum tube to form a double-walled structure in which the aluminum tube is pressure reformed to a shape of upper flat and lower circular surface. A lower tray is made of steel and pressed with recessed grooves. The double-walled electric heating-tube is disposed in the grooves of the tray and covered with an aluminum evenly-heating-plate. The evenly-heating-plate, the electric heating tube, and the lower tray is pressed to form an integral body. The outer wall of the electric heating-tube has a large contacting area with the evenly-heating-plate.

4 Claims, 2 Drawing Sheets

HOT PLATE WITH SHAPED DOUBLE WALLED ELECTRIC HEATING ELEMENT TO PROMOTE HEAT TRANSFER

BACKGROUND OF THE INVENTION

The present invention relates to an electric heating-plate and the method of manufacturing the same, particularly to a composite electric heating-plate with double-walled electric heating tube and the method of manufacturing the same.

Conventional electric heating-plates can be generally classified into the cast-in and inlaid types. The cast-in type further consists of cast aluminum and cast iron ones. The forming process of the cast-in type comprises the steps of coiling the electric heating-tube, casting melted aluminum or iron on the coiled electric heating-tube, and forming by machining. The cast aluminum type has a heat-transfer coefficient of approximately 140 and a melting temperature of 560°–580° C., although the heat-transfer coefficient of which is much greater than that of the cast-iron type, and has been widely used in electric rice pot etc., however, melting of the aluminum plate is subject to occur while it is used in high temperature and large power cooking such as stir-frying, deep-frying, crisp-frying, etc., thus it can not meet the various requirements of daily life. The forming process of the cast iron type is similar to that of the cast aluminum ones, although it has realized the object of use in high temperature and large power cooking, but there is a problem of low heat-transfer coefficient (approximately 50), furthermore, the melting point of cast iron is up to 1400° C., which causes difficulties in processing and consumes large amount of power, and the insulating layer of the electric heating-tube is easily subject to damage in the casting process. The manufacturing of the inlaid type comprises the steps of casting the aluminum plate and inlaying the electric heating-tube into the grooves of the aluminum plate, the heat-transfer coefficient and melting point of heating-plate of inlaid type equal to that of the cast aluminum type, respectively, so heating-plate of this type is only suitable to be used in low temperature and small power cooking, and this still can not meet the various requirements of daily life.

Also, U.S. Pat. No. 4,431,908 has disclosed an electric heating-plate, which comprises a metallic upper part and a metallic lower part, the upper surface of the upper part is a flat surface as the heating surface, a electric heating-tube is disposed between the upper and the lower parts, and the side of the heating-tube contacting with the upper part is flatly surfaced to keep a very large contacting area with the upper part to maintain good heat conductivity therein between. This apparatus exhibits better heat efficiency and adaption to high temperature and large power cooking, however, the manufacturing process of which is necessarily complicated, since this apparatus needs the electric heating-tube being welded on the upper part in vacuum condition. Furthermore, since the electric heating-tube usually is of steel walls and in cylindrical shape, it is very hard to process it into the shape with one side being a flat surface, such as a triangular prism, as required by this apparatus. In addition to expensive and complicated equipments, it has to consume large amount of power.

BRIEF DESCRIPTION OF THE INVENTION

It is an object of the present invention to provide a composite electric heating-plate with higher heat-transfer coefficient, thermal strength, and heat efficiency, as well as reduced power consumption and capable of meeting the requirements of high temperature and large power cookings.

It is another object of the present invention to provide a manufacturing method of said composite electric heating-plate, which may greatly simplify the process flow without the need of special equipments and is capable of reducing large amount of power and improving manufacturing environment.

The composite electric heating-plate according to the present invention comprises: a flat panel shaped upper evenly-heating-plate having higher heat-transfer coefficient, e.g., being made of aluminum, a lower recessed tray having higher melting point and low heat-transfer coefficient, e.g., being made of steel; and an electric heating-tube disposed between the upper evenly-heating-plate and the lower tray. The electric heating-tube is of a double-walled structure which is formed by sleeving an aluminum tube outside an ordinary electric heating-tube. The inner wall of the electric heating-tube, i.e., the original metallic tube of the ordinary electric heating-tube remains in its cylindrical shape, while its external wall aluminum tube is processed to be in a shape of contacting with the upper evenly-heating-plate in a larger area. The lower portion of the electric heating-tube is placed in the recesses of the lower tray. Apertures are provided in the lower tray for leading out the terminals of the electric heating-tube. There may be a plurality of sets of electric heating-tubes, so that the power of which may be adjustable. The shape of the overall electric heating-plate may be of arbitrary arched form as desired.

The method of manufacturing the composite electric heating-plate is as follows:

(a) forming a double-walled structure by sleeving an aluminum tube outside an ordinary electric heating-tube;

(b) reforming the external wall of the double-walled electric heating-tube so as to make the upper portion thereof in the form of a flat surface of larger area, while the lower portion remains in its circular shape or other shapes;

(c) forming the lower tray with recesses in it;

(d) inlaying the reformed double-walled electric heating tube into the recesses of the lower tray, and fixing the upper evenly-heating-plate with the two to form an integral body.

Wherein, the external wall of the electric heating-tube can be reformed by pressure reforming or other techniques; the forming process of the lower tray comprises cutting the material, stretching, punching and grooving; while the forming of the integral electric heating-plate comprises pressure welding, riveting or other techniques.

As compared with the prior art, the composite electric heating-plate and its manufacturing process according to the present invention has the following advantages: extremely simple in technology, high efficiency and energy saving, low cost, reduction of worker's labour strength, and improvement of labour environment, efficiently utilizing different properties of the aluminum and steel materials, utilizing the high thermal conductivity of aluminum and the thermal strength of steel, making the electric heating-plate meet the requirements of high temperature and large power cooking to be used in deep frying, crisp frying, stir frying, baking, etc.. In addition, since different materials are used, the heat-transfer properties of the upward surface (working surface) and downward surface are different, heat is conducted to working surface much more than that to the downward surface, thereby improving the efficiently and greatly saving energy. After test, the heat-transfer coefficient of the upper evenly-heating-plate of the electric heating-plate according to the present invention is 180–190, and the thermal efficiency up to 90% or more, the limiting working temperature is 600° C., and the power is adjustable.

A multi-function electric heating-pot can be formed by combining the composite electric heating-plate according to the present invention with a stainless pot, which works normally at 14.2 w/cm$^2$ in power density test (boiling water), that is, it works normally with thermal efficiency of 92% when a multi-function electric heating-pot of 1.8 KW rated power is supplied with an input power of 5.4 KW.

An electric frying pan can be formed by combining the composite electric heating-plate with the stainless steel pan, which has significant energy saving effect in baking cakes.

After test of maximum surface temperature, the electric heating-plate according to the present invention works normally at 600° C., while the cast aluminum electric heating-plate melts at 580° C., After test of limiting heating temperature inside the pot, that is, heating copper grains in a stainless steel pot, the electric heating-plate according to the present invention melts at 450° C., while the cast aluminum one melts at 360° C.

It is not necessary to melt and machine the materials in the manufacturing of the electric heating-plate according to the present invention, there is no waste of raw materials and power, not only the thermal strength is increased but also the cost is reduced by substituting part of the aluminum material with steel.

The present invention adopts pressure welding forming, which is of the advantages of high rate of finished products, high speed, good environmental conditions, pipeline operation, reduction of cost and simplified technology.

DETAILED DESCRIPTION OF THE PREFERRED EMBODIMENT

Figure 1:
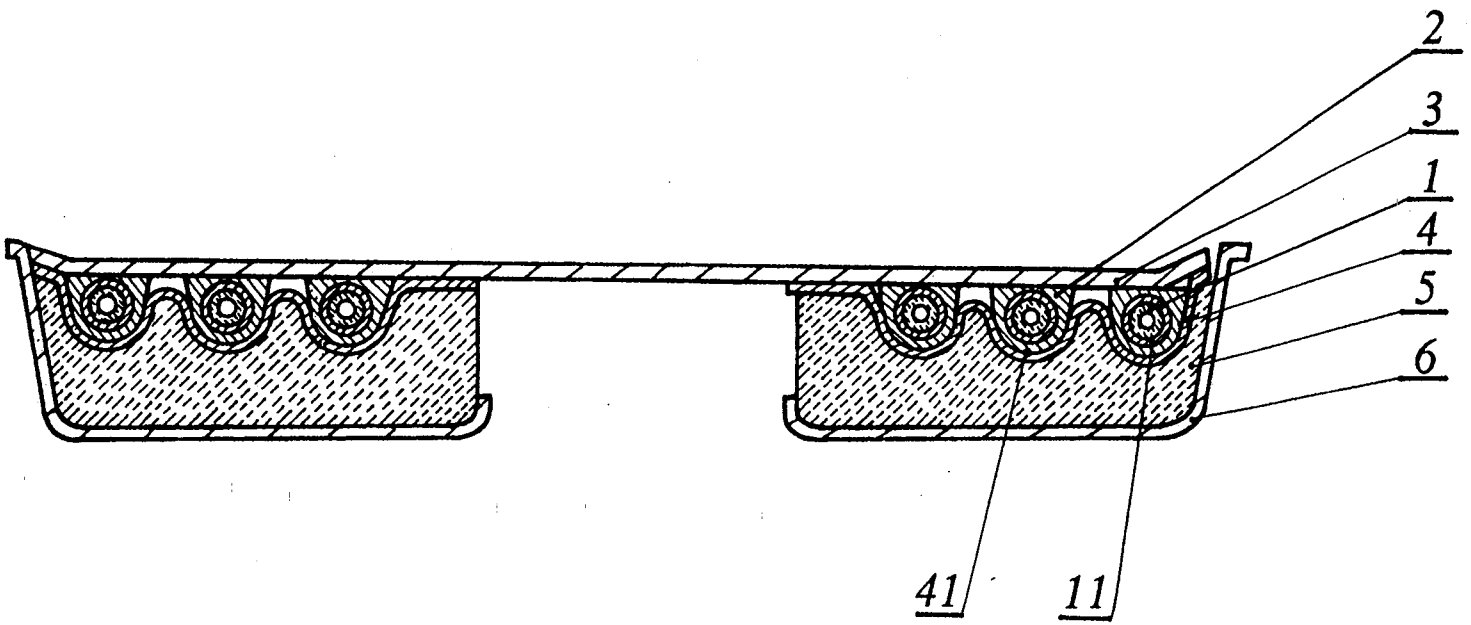
FIG. 1 is a schematic sectional view of a composite electric heating-plate of a preferred embodiment according to the present invention.

FIG. 1 is a schematic sectional view of a composite electric heating-plate of a preferred embodiment according to the present invention, wherein, 1 indicates ordinary electric heating-tube, 11 indicates its metallic tube, i.e., the inner wall of the double-walled electric heating-tube, 2 indicates the external aluminum tube of the double-walled electric heating-tube which has been reformed into the shape of flat in upper side and circular in lower side with the space at the corner angle of connection of the upper flat portion and the lower circular portion substantially filled portion and the lower circular portion substantially filled in during the pressure reforming process, so that the heat conductivity between the inner wall 11 and the upper portion of the external wall is very desirable, thereby the ordinary electric heating-tube 1 and the external aluminum tube 2 constitute a double-walled electric heating-tube. In the diagram, 3 indicates an evenly-heating-plate of flat panel shape, which is made of pure aluminum the evenly-heating-plate 3 is closely pressure welded together with the upper surface of the outer wall of the double-walled electric heating-tube. Grooves 41 are formed in an underneath supporting tray 4 made of steel, the double-walled electric heating-tube is disposed in the grooves, the terminals of the electric heating-tube extend out from apertures (not shown) in the tray. The electric heating-plate according to the present invention is constituted by pressure fixing forming the evenly-heating-plate, the double-walled electric heating-tube and the steel tray to form an integral body. Thermal insulation material aluminum silicate 5 may be filled underneath the steel tray 4 and put into a casing together with the electric heating-plate to provide heat preservation and a graceful appearance.

Figure 2:
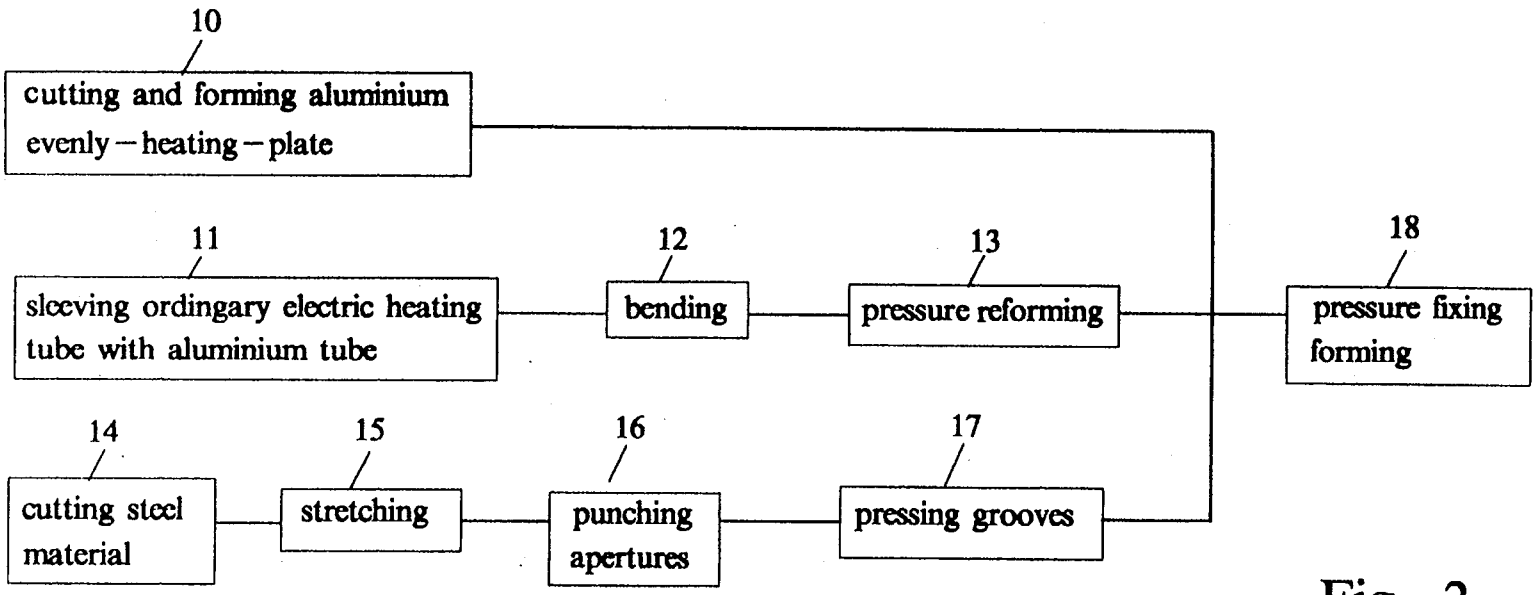
FIG. 2 is a flow chart illustrating the process of manufacturing the composite electric heating-plate of the preferred embodiment according to the present invention.

FIG. 2 is the technological flow chart of the manufacturing of the composite electric heating-plates, comprising:

Step 10, punch cutting and forming the aluminum evenly-heating-plate in a mould, prepared for use;

Step 11, sleeving an ordinary electric heating-tube with an aluminum tube;

Step 12, bending the aluminum tube sleeved electric heating-tube with a bender;

Step 13, pressure reforming the external aluminum tube with a mould press into the shape of an upper flat and lower circular surfaces, prepared for use;

Step 14, cutting the steel material;

Step 15, stretching the cut steel material;

Step 16, punching on the stretched steel material;

Step 17, pressure grooving to form the steel tray; and

Step 18, inlaying the reformed double-walled electric heating-tube into the grooves of the steel tray, extending the terminals of the electric heating-tube out of the aperture in the tray, putting the aluminum evenly-heating-plate on them, pressure fixing forming on a press.

While preferred embodiments of the present invention are described hereinbefore with reference to the drawings, however, it is not intended to limit the scope of the present invention, it is easy for those skilled in the art to make changes and modifications without departing from the spirit and scope of the present invention, the scope of the present invention is limited by the following claims.

What is claimed is:

1. A composite electric heating plate, comprising:

upper evenly heating plate having high heat transfer coefficient;

lower tray having high melting point and low heat-transfer coefficient with recessed grooves; and electric heating tube disposed between said upper evenly heating plate and said lower tray, said electric heating tube being of a double-walled structure formed by sleeving an aluminum tube on the outside of an ordinary electric heating tube such that the interior surface of said aluminum tube is in direct contact with the exterior surface of said ordinary electric heating tube and said aluminum tube completely encases said ordinary electric heating tube, the outer aluminum tube of said electric heating tube being processed into the shape with a larger contacting area with the upper evenly heating plate, and the lower portion of which being substantially disposed in the recessed grooves of said lower tray.

2. The electric heating plate according to claim 1, wherein said upper evenly heating plate is an aluminum plate, and said lower tray is made of steel.

3. The electric heating plate according to claim 1, wherein said upper evenly heating plate is planar, and the outer wall of said double-walled electric heating tube has a planar upper portion and a circular lower portion.

4. The electric heating plate according to claim 1, the shape of which is arbitrarily arched.

* * * * *